US008500098B2

(12) United States Patent
Li

(10) Patent No.: US 8,500,098 B2
(45) Date of Patent: Aug. 6, 2013

(54) ELEVATION MECHANISM

(75) Inventor: Hai-Yuan Li, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 278 days.

(21) Appl. No.: 12/609,295

(22) Filed: Oct. 30, 2009

(65) Prior Publication Data

US 2011/0037039 A1 Feb. 17, 2011

(30) Foreign Application Priority Data

Aug. 12, 2009 (CN) ..... 2009 1 0305539

(51) Int. Cl.

| | |
|---|---|
| ***B66F 7/16*** | (2006.01) |
| ***B66F 3/36*** | (2006.01) |
| ***B66F 3/00*** | (2006.01) |
| ***B66F 3/22*** | (2006.01) |

(52) U.S. Cl.
USPC ..... 254/122; 254/124; 254/126; 254/100; 254/93 L

(58) Field of Classification Search
USPC ..... 254/122, 124, 126, 100, 103, 134, 254/93 L
See application file for complete search history.

(56) References Cited

U.S. PATENT DOCUMENTS

| | | | | |
|---|---|---|---|---|
| 3,623,707 | A * | 11/1971 | Klopp | 254/22 |
| 2003/0047388 | A1 * | 3/2003 | Faitel | 187/214 |
| 2008/0296542 | A1 * | 12/2008 | Manev et al. | 254/88 |
| 2008/0308357 | A1 * | 12/2008 | Coble | 187/200 |
| 2009/0236787 | A1 * | 9/2009 | Sandmeier | 269/95 |

FOREIGN PATENT DOCUMENTS

| | | | |
|---|---|---|---|
| CN | 201025460 | Y | 2/2008 |
| CN | 100564230 | C | 12/2009 |

* cited by examiner

*Primary Examiner* — Monica Carter
*Assistant Examiner* — Seahee Yoon
(74) *Attorney, Agent, or Firm* — Altis Law Group, Inc.

(57) ABSTRACT

An elevation mechanism includes a platform, a base assembly, a scissor lift assembly and a sliding assembly. The base assembly includes a threaded rod having two threaded portions and two threaded members threadedly engaging with the threaded rod. Rotation directions of the two threaded portion are opposite to each other. The scissor lift assembly includes a plurality of articulated first scissor legs and a plurality of articulated second scissor legs pivotedly coupled to the respective second scissor legs. The sliding assembly includes two fixing members fixed to the platform, a sliding rod fixed between the two fixing members, and two sliding members slidablely connected to the sliding rod. The two sliding members are correspondingly pivotedly connected to the upmost first and second scissor leg. The two threaded members are pivotedly connected to the lowermost first and second scissor legs.

17 Claims, 7 Drawing Sheets

ELEVATION MECHANISM

BACKGROUND

1. Technical Field

The present disclosure relates to elevation mechanisms, and particularly, to an elevation mechanism utilizing a scissor lift support.

2. Description of the Related Art

Elevation mechanisms have been widely used in many applications for many years, such as, or example, elevating automobiles, building components, supplies, structural components, scaffolding, work stands, patient beds and many others.

A commonly used elevation mechanism includes a base assembly, a platform, and a scissor lift assembly movably interconnecting the base assembly and the scissor lift assembly. The base assembly includes a support member, a threaded rod and a threaded member. The threaded rod is fixed on the support member. The threaded member sleeves on the threaded rod. The scissor lift assembly includes a scissor support and a wheel. The scissor support includes a first scissor leg and a second scissor leg pivotedly attached to the first scissor leg in a middle portion. The wheel is pivotedly connected to an end of the first scissor leg. The threaded member is pivotedly connected to the other end of the first scissor leg. The platform and the support member are correspondingly pivotedly connected to opposite ends of the second scissor leg. The platform defines a retaining groove to receive the wheel. When the threaded rod is rotated in a clockwise direction, the threaded member slides the threaded rod to toward the end of the second scissor leg. An angle of the first scissor leg relative to the second scissor leg is increased, such that the scissor lift assembly raises the platform. When the threaded rod is rotated in a counterclockwise direction, the threaded member slides the threaded rod away from the end of the second scissor leg. An angle of the first scissor leg relative to the second scissor leg is decreased, such that the scissor lift assembly lowers the platform. However, the support center of the platform deviates to an edge of the platform as the wheel slides toward the edge of the platform, such that a heavy load cannot be stably supported on the platform.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

Figure 1:
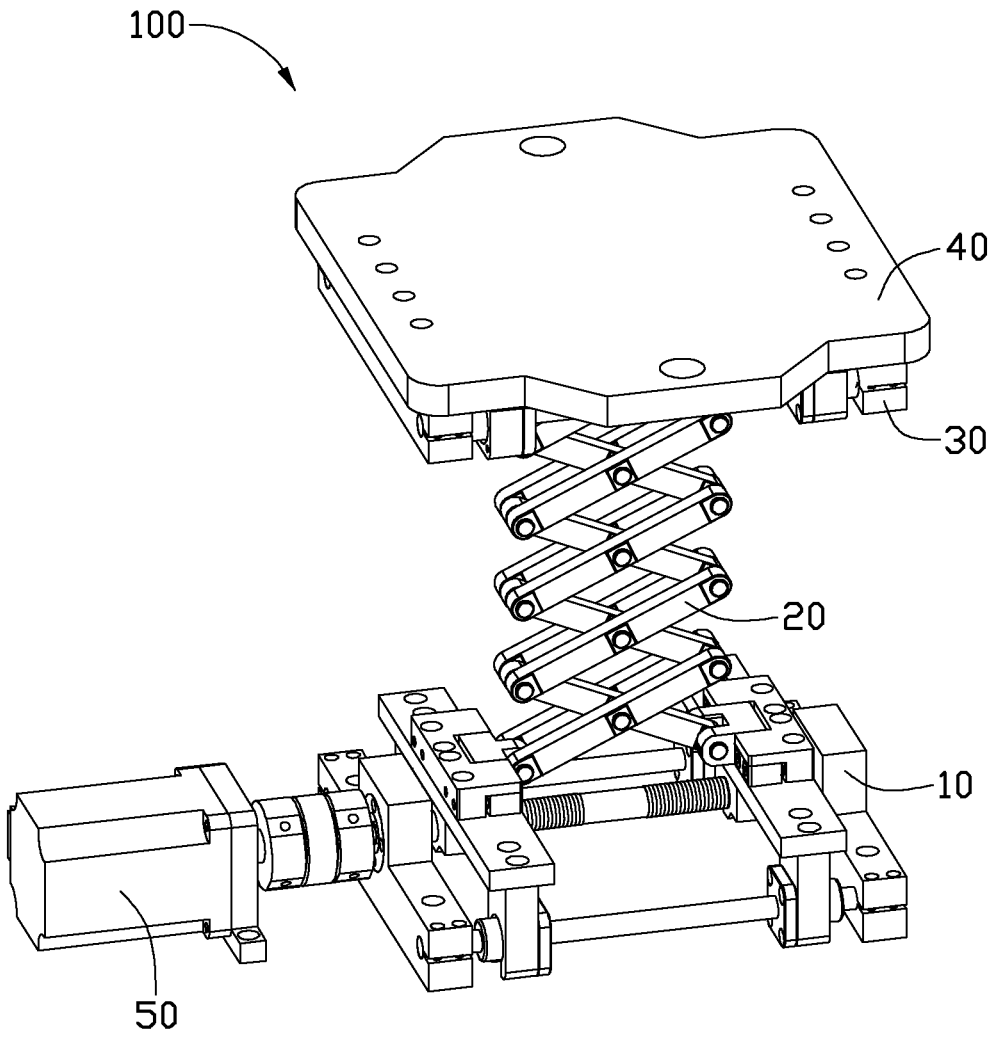
FIG. 1 is an assembled, isometric view of a first embodiment of an elevation mechanism including a base assembly, a scissor lift assembly, a sliding assembly, and a platform.
Figure 2:
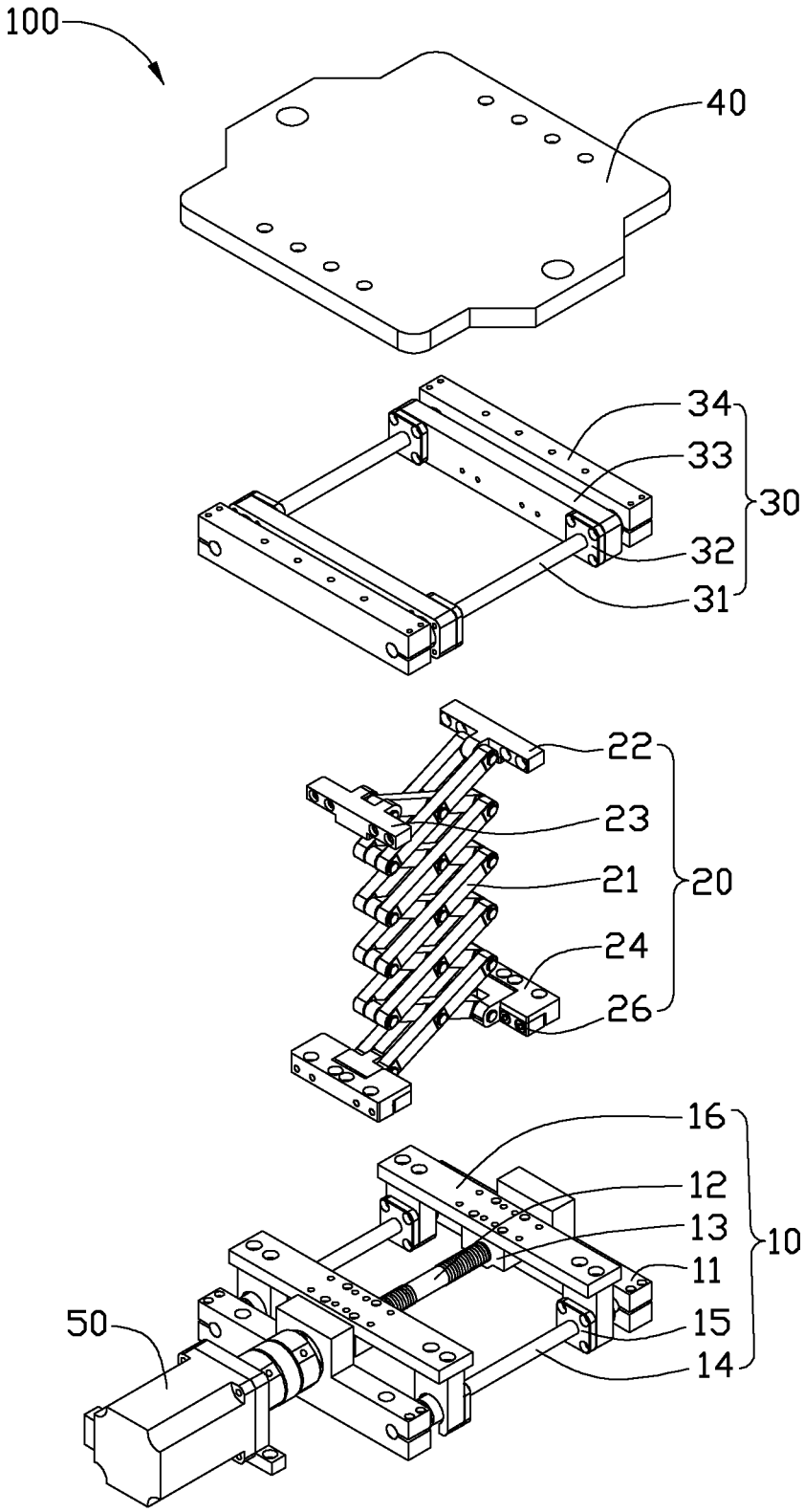
FIG. 2 is a partial, exploded, isometric view of the elevation mechanism shown in FIG. 1.

Referring to FIGS. 1 and 2, a first embodiment of an electronic device 100 as disclosed includes a base assembly 10, a scissor lift assembly 20, a sliding assembly 30, a platform 40, and a drive device 50. The scissor lift assembly 20 movably interconnects the base assembly 10 and the sliding assembly 30. The platform 40 is positioned on the sliding assembly 30. The drive device 50 is connected to the base assembly 10 to drive the scissor lift assembly 20.

Figure 3:
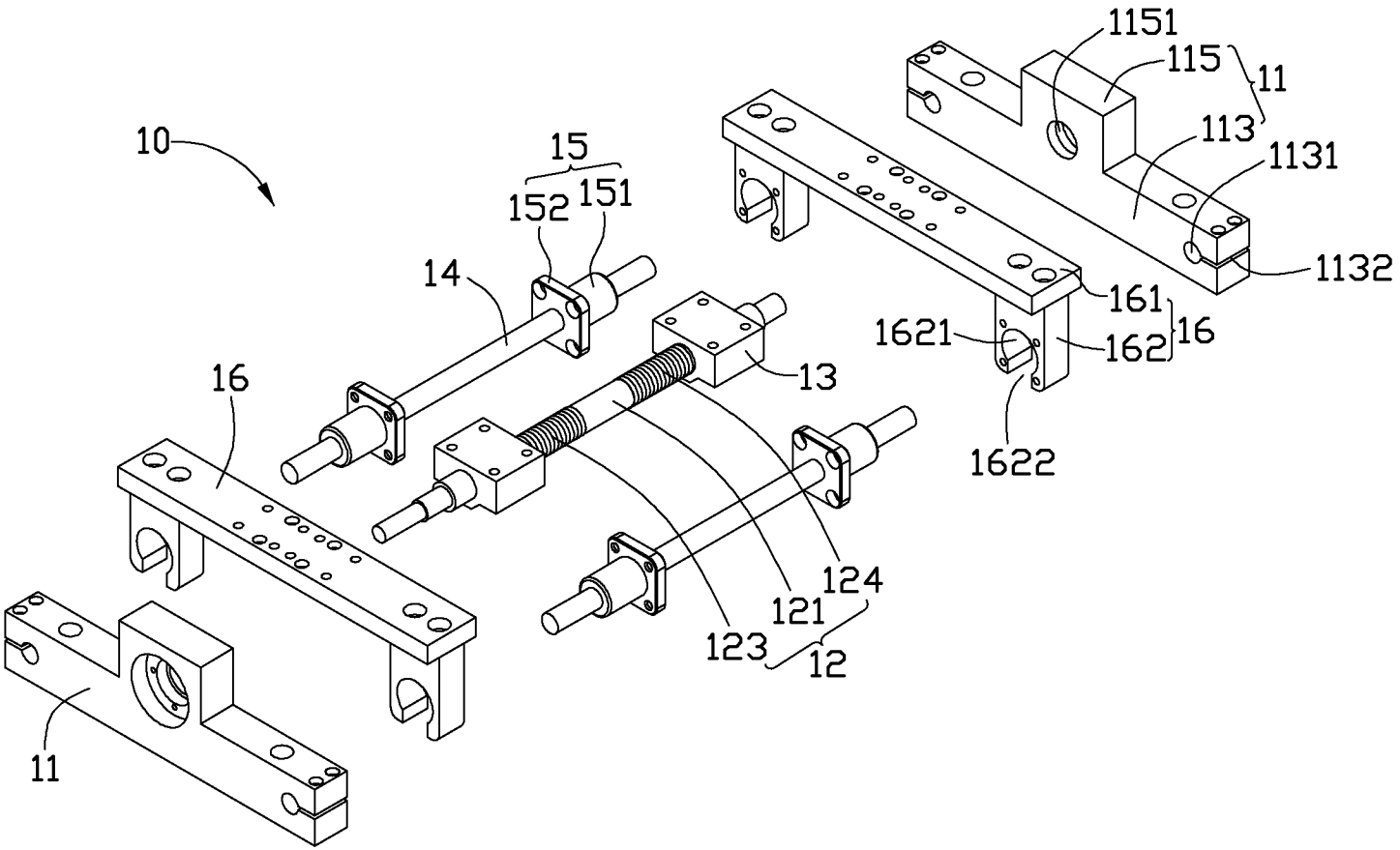
FIG. 3 is an exploded, isometric view of the base assembly of the elevation mechanism shown in FIG. 1.

Referring to FIG. 3, the base assembly 10 includes two support members 11, a threaded rod 12, two threaded members 13, two guide rods 14, two pairs of sleeves 15, and two sliding members 16. Two ends of the threaded rod 12 correspondingly pass through the two support members 11. The threaded rod 12 is sleeved with the two threaded members 13. The two guide rods 14 are fixed between the two support members 11, parallel to the threaded rod 12. Each of the guide rods 14 are sleeved with one pair of the sleeves 15. The two sliding members 16 are fixed to the two threaded members 13, and attached on the two pairs of sleeves 15 correspondingly. The two sliding members 16 are slidable relative to the threaded rod 12 and the guide rods 14.

Each support member 11 includes a base 113 and a connecting portion 115. The connecting portion 115 extends from a middle portion of a side surface of the base 113 outward. The base 113 defines two through holes 1131 and two slots 1132 in opposite ends of the base 113. The two slots 1132 communicate with the corresponding through holes 1131. The connecting portion 115 defines a stepped hole 1151 in a middle portion of the connection portion 115.

The threaded rod 12 includes a main body 121 and two threaded portions 123,124. The two threaded portions 123, 124 are formed at opposite ends of the main body 121. Rotation in a forward direction of the threaded portion 123 is opposite to that of the threaded portions 124. The two threaded members 13 threadedly engage with the corresponding threaded portions 123,124.

Each sleeve 15 includes a barrel portion 151 and a fixing portion 152. The fixing portion 152 connects an end of the barrel portion 151.

Each sliding member 16 includes a baseplate 161 and two connecting portions 162. The two connecting portions 162 are fixed to opposite ends of a side of baseplate 161. The threaded member 13 is fixed to the baseplate 161 between the two connecting portions 162. Each connecting portion 162 defines a through hole 1621 in a middle portion of each connecting portion 162. Each connecting portion 162 further defines a gap 1622 in an end of each connecting portion 162. The gap 1622 communicates with the through hole 1621. The sleeves 15 are received in the guide rods 14 in the corresponding through holes 1621 of the sliding member 16.

Figure 4:
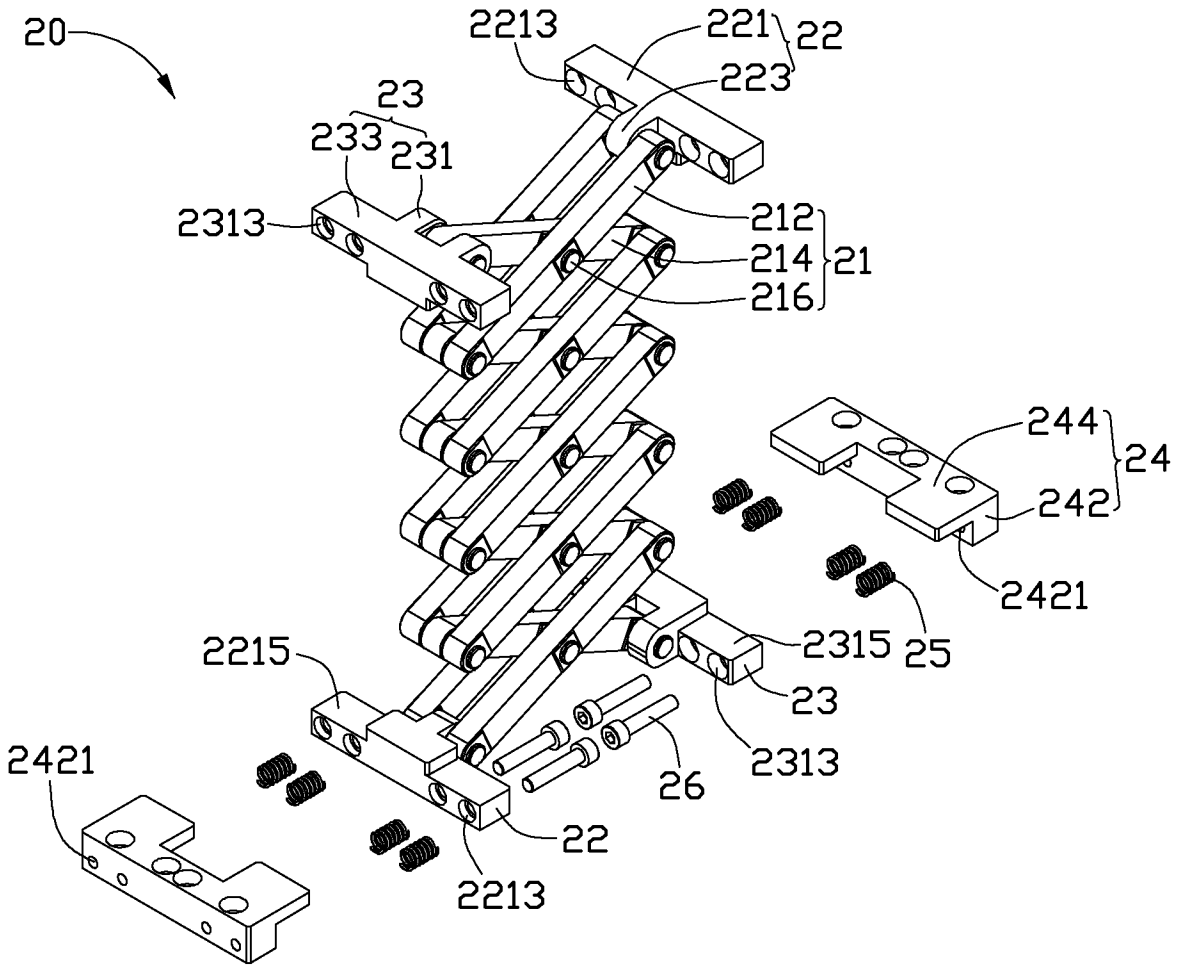
FIG. 4 is an exploded, isometric view of the scissor lift assembly of the elevation mechanism shown in FIG. 1.

Referring to FIG. 4, the scissor lift assembly 20 includes a plurality of scissor supports 21, two first connecting members 22, two second connecting members 23, two fixing members 24, a plurality of springs 25, and a plurality of fixing shafts 26. The scissor supports 21 are pivotedly connected to one another. The fixing shafts 26 correspondingly pass through the first connecting member 22 and the second connecting member 23, and are finally fixed to the fixing members 24. The fixing shafts 26 are sleeved with the corresponding springs 25. Fixing shafts 26 may be rivets, bolts, screw fasteners, or other.

Each scissor support 21 includes two first scissor legs 212, a second scissor leg 214, and a pivotal shaft 216. The second scissor leg 214 is positioned between the two first scissor legs 212. The pivotal shaft 216 passing through a middle portion of one of the first scissor legs 212, the second scissor leg 214, and the other first scissor leg 212 in that order. The outermost first scissor legs 212 of the scissor lift assembly 20 are correspondingly pivotedly connected to one of the first connecting members 22 and one of the second connecting members 23. The outermost second scissor legs 214 of the scissor lift assembly 20 are correspondingly pivotedly connected to the other first connecting members 22 and the other second connecting members 23.

Each first connecting member 22 includes a fixing portion 221 and a connecting portion 223. The connecting portion 223 extends from a middle portion of the fixing portion 221 outward. The fixing portion 221 defines a plurality of the stepped holes 2213 and two positioning steps 2215. The stepped holes 2213 are defined in a side of the fixing portion 221 at two sides of the connecting portion 223. The two positioning steps 2215 are defined in opposite ends of the other side of the fixing portion 221 adjoining the side defining the stepped holes 2213. The connecting portions 223 are pivotedly connected to free end of the first outermost scissor leg 212.

Each second connecting member 23 includes two fixing portions 231 and a connecting portion 233. The two connecting portions 233 extend from a middle portion of the fixing portion 231, and are spaced from each other. The fixing portion 231 defines a plurality of the stepped holes 2313 and two positioning steps 2315. The stepped holes 2313 are defined in the side of the fixing portion 221 at two sides of the connecting portion 233. The two positioning steps 2315 are defined in opposite ends of the other side of the fixing portion 231 adjoining the side defining the stepped holes 2213. The connecting portions 233 are pivotedly connected to free end of the outermost second scissor leg 214.

Each fixing member 24 includes a base 242 and two positioning portions 244. The two positioning portions 244 extend from a side of the base 242, and are spaced apart at the two ends of a side of the base 242. The two positioning portions 244 of one fixing member 24 engage with the corresponding positioning steps 2215 of the first connecting member 22. The two positioning portions 244 of other fixing member 24 engage with the corresponding positioning steps 2315 of the second connecting member 23.

Each spring 25 is substantially cylindrical, and is partially received in the respective stepped hole 2213 of the first connecting member 22 or the respective stepped hole 2313 of the second connecting member 23.

Figure 5:
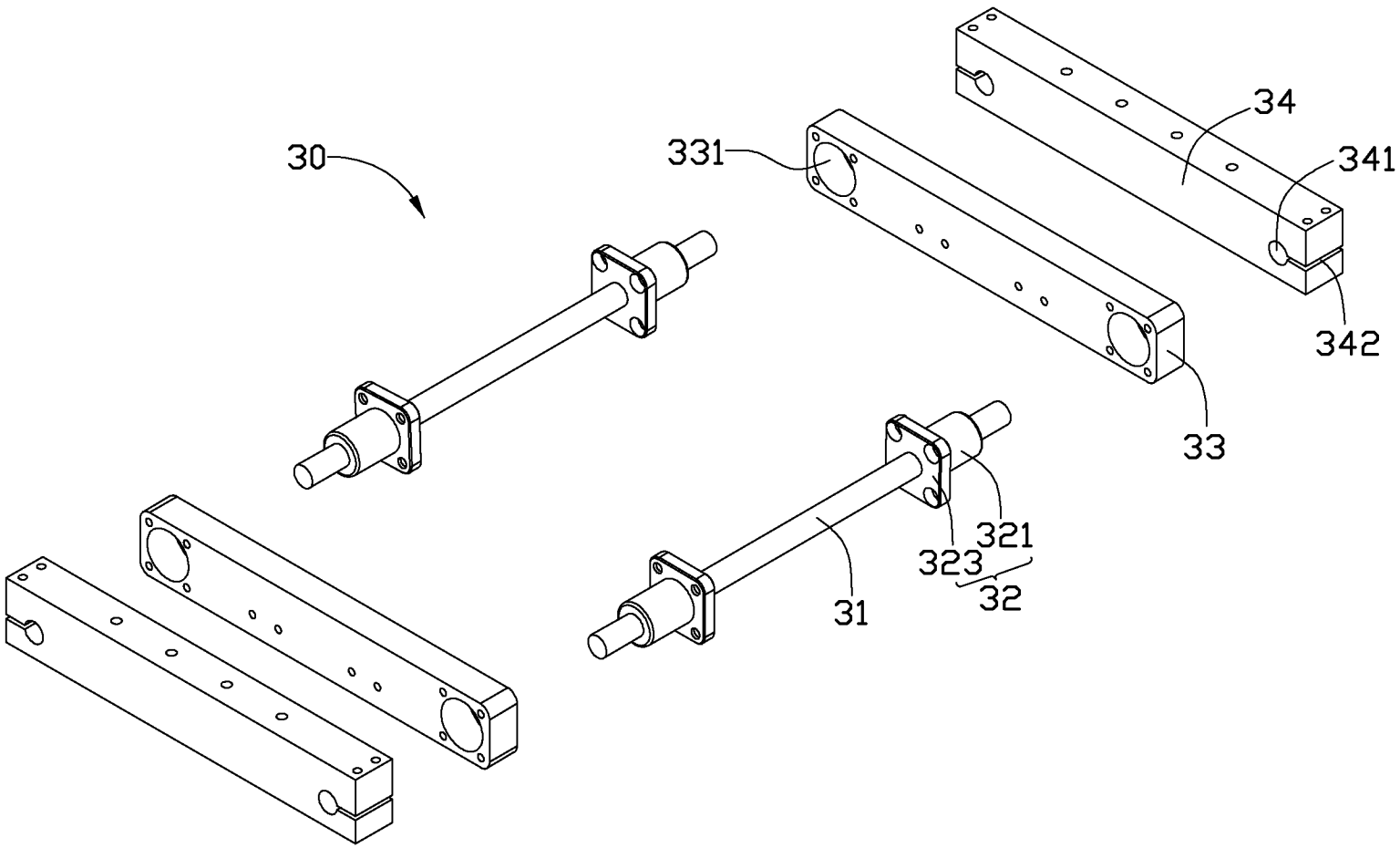
FIG. 5 is an exploded, isometric view of the sliding assembly of the elevation mechanism shown in FIG. 1.

Referring to FIG. 5, the sliding assembly 30 includes two sliding rods 31, two pairs of sleeves 32, two sliding members 33, and two fixing members 34. The two sliding rods 31 are fixed between the two fixing members 34, parallel to each other. The two sliding rods 31 are correspondingly sleeved with two pairs of sleeves 32. The two sliding members 33 are correspondingly sleeved with the two pairs of sleeves 32, and can be slid relative to the sliding rods 31.

Each sleeve 32 includes a barrel portion 321 and a fixing portion 323. The fixing portion 323 connects the barrel portion 321. Each sliding member 33 defines two through holes 331 in opposite ends of the corresponding sliding member 33. The barrel portions 321 are received in the corresponding through holes 331 of the sliding members 33. Each fixing member 34 defines two fixing holes 341 and two slots 342 in opposite ends of the corresponding fixing member 34. The two slots 342 communicate with the corresponding through holes 341.

In the illustrated embodiment, the drive device 50 is an actuator motor. The drive device 50 is pivotally connected to and rotates the threaded rod 12.

Referring to FIGS. 2 through 5, the elevation mechanism 100 may be assembled as follows.

Two threaded portions 123, 124 of the threaded rod 12 are first sleeved with the threaded members 13. The two guide rods 14 are then correspondingly sleeved with the corresponding sleeves 15. The two ends of the two guide rods 14 are fixed in the corresponding through holes 1131 of the two support members 11. The two ends of the threaded rod 12 are received in the corresponding stepped holes 1151 of the two support members 11. The baseplates 161 of the two sliding members 16 are fixed to the corresponding threaded members 13. The connecting portions 162 of the two sliding members 16 sleeved the corresponding sleeves 15.

The plurality of scissor supports 21 are pivotedly connected to one another. The two first connecting members 22 are correspondingly pivotedly connected to free end of the outermost first scissor legs 212 of the scissor lift assembly 20. The two second connecting members 23 are correspondingly pivotedly connected to free end of the outermost second scissor legs 214 of the scissor lift assembly 20. Some of the fixing shafts 26 correspondingly pass through the lowermost first connecting member 22 of the scissor lift assembly 20, the springs 25, and the fixing member 24. The other fixing shafts 26 correspondingly pass through the lowermost second connecting member 23 of the scissor lift assembly 20, the springs 25, and the fixing member 24. The lower ermost first and second connecting member 22,23 of the scissor lift assembly 20 can be slid relative to the fixing members 24, and resist the springs 25.

The two pairs of sleeves 32 are sleeved with the corresponding sliding rods 31. The two sliding members 33 are sleeved with the corresponding sleeves 32. The two ends of the two sliding rods 31 are fixed in the corresponding fixing holes 341 of the two fixing members 34.

Finally, the two fixing members 24 of the scissor lift assembly 20 are fixed to the corresponding sliding members 16 of the base assembly 10. The two sliding members 33 of the sliding assembly 30 are correspondingly fixed to the uppermost first and second connecting member 22,23 of the scissor lift assembly 20. The platform 40 is fixed to the two fixing members 34 of the sliding assembly 30.

When the drive device 50 rotates the threaded rod 12 in a clockwise direction, the two threaded members 13 slide the threaded rod 12 toward each other. An angle of the first scissor leg 212 relative to the second scissor leg 214 of the scissor lift assembly 20 is decreased, such that the scissor lift assembly 20 raises the platform 40. When the drive device 50 rotates the threaded rod 12 in a counterclockwise direction, the two threaded members 13 slide the threaded rod 12 away from each other. The angle of the first scissor leg 212 relative to the second scissor leg 214 of the scissor lift assembly 20 is increased, such that the scissor lift assembly 20 lowers the platform 40.

The sliding members 33 can be slid toward or away from each other, such that the support center of the platform 40 does not deviate when supporting heavy loads. In addition, the threaded rod 12 includes two threaded portions 123,124 engaging with the two threaded members 13, which in turn drive the scissor lift assembly 30 to lift more quickly. The springs 25 on the corresponding fixing shafts 26, resist the corresponding fixing members 24, and thus provide a resilient buffering force to the scissor lift assembly 20.

It is to be understood that the guide rods 14, the sleeves 15 and the sliding members 16 can also be omitted, wherein the first scissor leg 212 and the second scissor leg 214 at the bottom of the scissor lift assembly 20 are pivotedly connected to the corresponding threaded members 13. The sliding members 33 can also be omitted, wherein the first scissor leg 212 and the second scissor leg 214 at the top of the scissor lift assembly 20 are pivotedly connected to the corresponding sleeves 32. The first connecting members 22 can also be the same as the second connecting members 23, in which case the scissor support 21 includes same numbers of first scissor leg 212 and second scissor leg 214. Sliding rod 31 can also be only singular, wherein the number of sleeves 32 is two.

Figure 6:
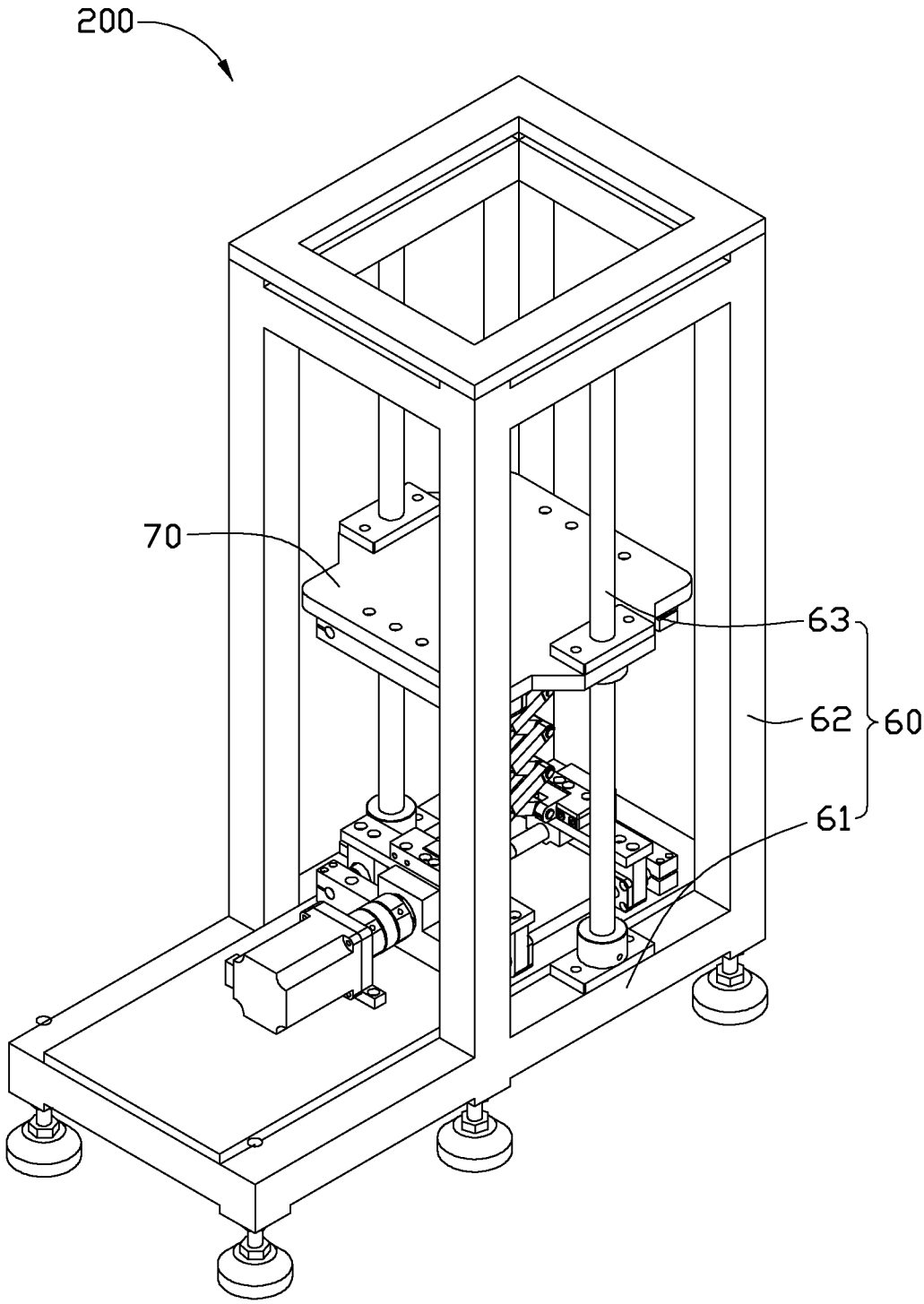
FIG. 6 is an assembled, isometric view of a second embodiment of an elevation mechanism.

Referring to FIG. 6, a second embodiment of an elevation mechanism 200 differs from the elevation mechanism 100 only in the inclusion of a fixing frame 60. The fixing frame 60 includes a baseplate 61, a support bracket 62, and two guide rods 63. The support bracket 62 is fixed to the baseplate 61. The two guide rods 63 fixedly interconnect the baseplate 61 and the support bracket 62, and pass through the platform 70. The platform 70 is slidable relative to guide rods 63.

Figure 7:
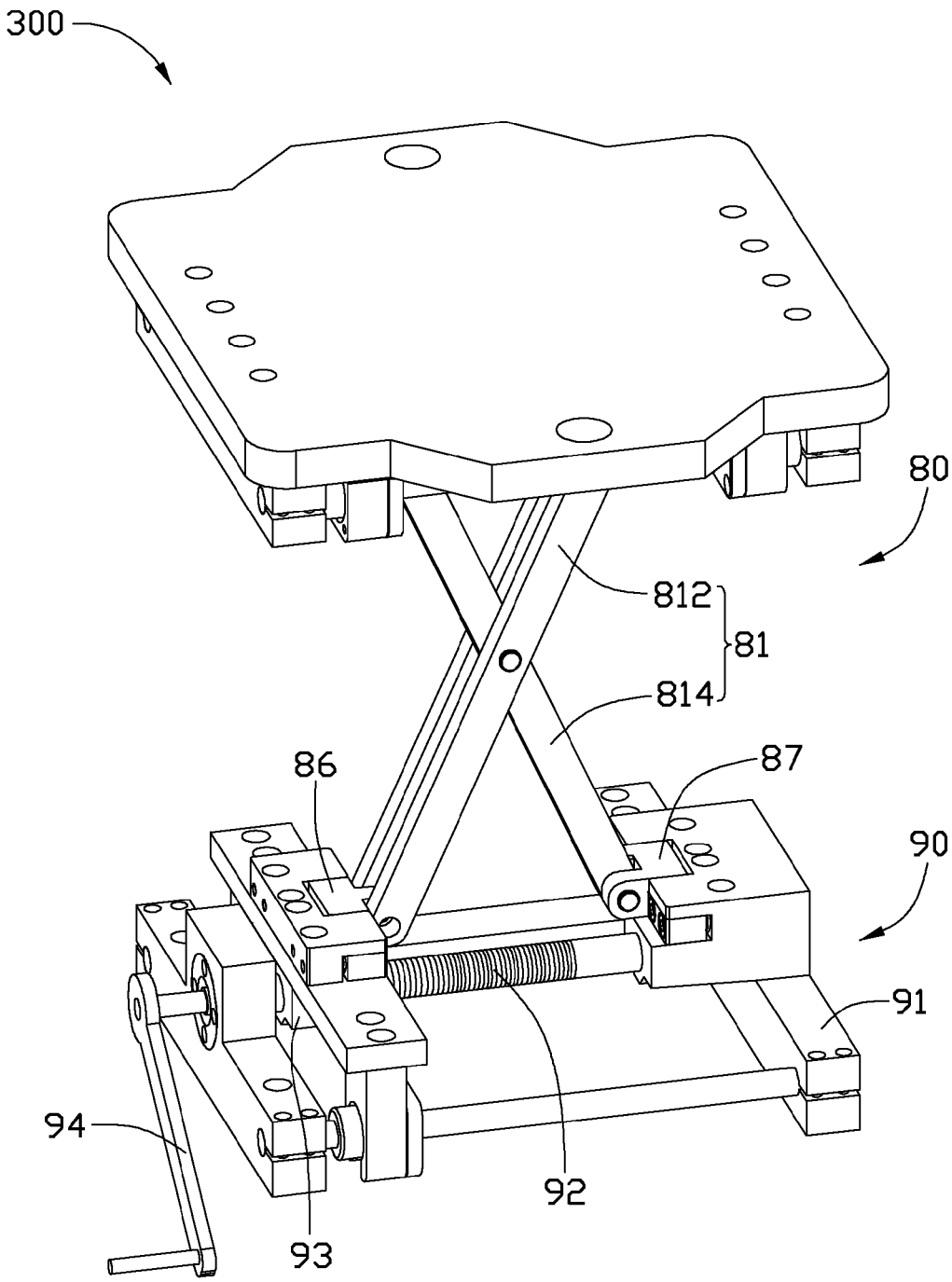
FIG. 7 is an assembled, isometric view of a third embodiment of an elevation mechanism.

Referring to FIG. 7, a third embodiment of a elevation mechanism 300 differs from the first embodiment of the elevation mechanism 100 only in that scissor lift assembly 80 includes only singular scissor support 81, which includes a first scissor leg 812 and a second scissor leg 814 pivotedly connected to the first scissor leg 812, and an end of the second scissor leg 814 is pivotedly connected to one of the support members 87, and further in that base assembly 90 further includes a handle 94 and only singular threaded member 93. The handle 94 is fixed to the threaded rod 93, and rotates the threaded rod 93.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. An elevation mechanism comprising:

a platform;

a base assembly comprising a threaded rod, two threaded members, and two sliding members fixed to the corresponding threaded members, the threaded rod comprising two threaded portions threadedly engaging with the corresponding threaded members, wherein directions of rotation of the two threaded portions are opposite;

a scissor lift assembly having a lower end and an upper end; and a sliding assembly comprising two fixing members, a sliding rod fixed between the two fixing members, and two sliding members sleeving the sliding rod, wherein the two fixing members are fixed to the platform; the two sliding members of the sliding assembly are pivotedly connected to the upper end of the scissor lift assembly; and the two threaded members are pivotedly connected to the lower end of the scissor lift assembly via the corresponding sliding members; the scissor lift assembly comprises a plurality of articulated first scissor legs, a plurality of articulated second scissor legs pivotedly coupled to the respective first scissor legs via a plurality of pivotal shafts, two first connecting members pivotedly connected to free ends of the outermost first scissor legs of the scissor lift assembly, two second connecting members pivotedly connected to free ends of the outermost second scissor legs of the scissor lift assembly, two fixing members, and two springs; one of the two first connecting members and one of the two fixing members of the scissor lift assembly are fixed to one of the two sliding members of the base assembly, and one of the two springs is positioned between and resists against the one of the two first connecting members and the one of the two fixing members of the scissor lift assembly; and one of the two second connecting members and the other of the two fixing members of the scissor lift assembly are fixed to the other sliding member of the base assembly, and the other of the two springs is placed between and resists against the one of the two second connecting members and the other of the two fixing members of the scissor lift assembly.

2. The elevation mechanism of claim 1, wherein the sliding assembly further comprises a pair of sleeves sleeving the sliding rod and fixed to the corresponding sliding members of the sliding assembly.

3. The elevation mechanism of claim 1, wherein the scissor lift assembly comprises two fixing shafts fixed to the corresponding fixing members of the scissor lift assembly; one of the two fixing shafts passes through the first connecting member and one of the two springs, and the other of the two fixing shafts pass passes the second connecting member and the other of the two springs.

4. The elevation mechanism of claim 1, wherein the base assembly comprises two support members, two guide rods fixedly interconnecting the two support members and parallel to the threaded rod, and two pairs of sleeves sleeving the corresponding guide rods; wherein the two sliding members of the base assembly are fixed to the corresponding sleeves, and the two sliding members of the base assembly are slidable toward or away from each other due to rotation of the threaded members relative to the threaded rod.

5. The elevation mechanism of claim 4, wherein each of the support members comprises a base and a connecting portion extending from a middle portion of a side surface of the base, the base defines two through holes in opposite ends thereof and two slots communicating with the corresponding through holes, opposite ends of each of the guide rods fixed in the corresponding through holes; the connecting portion defines a stepped hole in the middle portion thereof, two ends of the threaded rod passing through the corresponding stepped holes of the connection portion.

6. The elevation mechanism of claim 4, wherein each of the sleeves comprises a barrel portion and a fixing portion extending from an end of the barrel portion, the barrel portion sleeving the corresponding guide rod, the fixing portion fixed to the corresponding sliding member of the base assembly.

7. The elevation mechanism of claim 6, wherein each of the sliding members of the base assembly comprises a baseplate and two connecting portions fixed on opposite ends of a side of the baseplate, each of the connecting portions defines a through hole in a middle portion thereof and a gap communicating with the through hole; the sleeves are received in the corresponding through holes.

8. The elevation mechanism of claim 1, further comprising a fixing frame, the frame comprising a baseplate, a support bracket fixed to the baseplate, and two guide rods fixedly interconnecting the baseplate and the support bracket, the two guide rods passing through the platform.

9. An elevation mechanism comprising:

a platform;

a base assembly comprising two support members, a threaded rod fixed between the two support members, a threaded member threadedly engaging with the threaded rod, and a sliding member fixed to the threaded member;

a scissor lift assembly comprising a plurality of scissor supports pivotedly connected to one another, a fixing member, a spring, and two first connecting members; each scissor support comprising two first scissor legs, a second scissor leg positioned between the two first scissor legs, and a pivotal shaft, the pivotal shaft passing through a middle portion of one of the first scissor legs, the second scissor leg, and the other first scissor leg in that order, thereby pivotedly coupling the two first scissor legs and the second scissor leg together via the pivotal shaft; and a sliding assembly comprising two fixing members, a sliding rod fixed between the two fixing members, and two sliding members sleeving the sliding rod, wherein the two fixing members are fixed to the platform; the two sliding members of the sliding assembly are pivotedly connected to the uppermost first and second scissor leg of the scissor lift assembly; the sliding member of the base assembly and one of the support members are correspondingly pivotedly connected to the lowermost first and second scissor legs of the scissor lift assembly; the two first connecting members are pivotedly connected to free ends of the outermost first scissor legs of the scissor lift assembly, one of the two first connecting members and the fixing member of the scissor lift assembly are fixed to the sliding member of the base assembly, and the spring is positioned between and resists against the one of the two first connecting members and the fixing member of the scissor lift assembly.

10. The elevation mechanism of claim 9, wherein the sliding assembly further comprises a pair of sleeves sleeving the sliding rod and fixed to the corresponding sliding members of the sliding assembly.

11. The elevation mechanism of claim 9, wherein the scissor lift assembly further comprises two second connecting members, and the two second connecting members are pivotedly connected to free end of the outermost second scissor legs of the scissor lift assembly.

12. The elevation mechanism of claim 11, wherein the scissor lift assembly comprises, a fixing shaft fixed to the fixing member, the fixing shaft passes through the first connecting member and the spring.

13. The elevation mechanism of claim 9, wherein the base assembly further comprises another threaded member threadedly engaging with the threaded rod, two guide rods fixedly interconnecting the two support members, parallel to the threaded rod, two pairs of the sleeves sleeving the corresponding guide rods, and another sliding member fixed to the corresponding threaded member and the corresponding sleeves; wherein the two sliding members of the base assembly are slidable toward or away from each other due to rotation of the two threaded members relative to the threaded rod.

14. The elevation mechanism of claim 13, wherein each of the sleeves comprises a barrel portion and a fixing portion extending from an end of the barrel portion, wherein the barrel portions sleeving the corresponding guide rods, and the fixing portions are fixed to the corresponding sliding members_of the base assembly.

15. The elevation mechanism of claim 14, wherein each of the sliding members of the base assembly comprises a baseplate and two connecting portions arranged at opposite ends of a side of the baseplate, each connecting portion defines a through hole in a middle portion thereof and a gap communicating with the through hole; the sleeves are received in the corresponding through holes.

16. The elevation mechanism of claim 13, wherein each of the support members comprises a base and a connecting portion extending from the middle portion of side surface of the base, the base defines two through holes in opposite ends thereof and two slots communicating with the corresponding through holes, two ends of the guide rods fixed in the corresponding through holes; the connecting portion defines a stepped hole in a middle portion thereof, two ends of the threaded rod pass through the corresponding stepped holes.

17. The elevation mechanism of claim 9, further comprising a fixing frame, the frame comprising a baseplate, a support bracket fixed to the baseplate, and two guide rods fixedly interconnecting the baseplate and the support bracket, the two guide rods passing through the platform.

* * * * *